United States Patent [19]

Brunn

[11] 4,143,602

[45] Mar. 13, 1979

[54] ADJUSTABLE-HEIGHT ARTICLE OF FURNITURE

[76] Inventor: Oswald Brunn, Bunzlauer Platz 1, Munich, Fed. Rep. of Germany

[21] Appl. No.: 840,599

[22] Filed: Oct. 11, 1977

[51] Int. Cl.[2] ..... A47B 3/02

[52] U.S. Cl. ..... 108/117

[58] Field of Search ..... 108/117; 248/432; 24/130

[56] References Cited

U.S. PATENT DOCUMENTS

| | | | |
|---|---|---|---|
| 223,404 | 1/1880 | St. Clair | 108/117 |
| 518,132 | 4/1894 | Bevan | 24/130 |
| 3,574,900 | 4/1971 | Emery | 24/130 |

FOREIGN PATENT DOCUMENTS

| | | | |
|---|---|---|---|
| 729,630 | 5/1955 | United Kingdom | 108/117 |

*Primary Examiner*—James C. Mitchell
*Attorney, Agent, or Firm*—Albert L. Jeffers

[57] ABSTRACT

An adjustable-height article of furniture, such as a table, includes a generally horizontal top member, and a pair of transversely spaced, elongated leg members each having opposite ends. The top member includes transversely spaced longitudinal elements having longitudinally extending, elongated slots formed therein. One end of each leg member has a pin secured thereto which is slidably received in a respective slot, the other end being adapted to engage a supporting surface. A pair of transversely spaced, elongated support members is provided each having opposite ends, one end of each support member being pivotally connected to the top member at a point longitudinally spaced from the slots, and a point on each support member spaced from the one end being pivotally connected to a respective leg member intermediate its ends. Elongated flexible elements, such as lengths of rope, are provided each having one end secured to a respective leg member adjacent its one end, and a pair of wedge members are provided on the top member respectively spaced longitudinally from the slots in the direction of the support members which receive and adjustably clamp the flexible elements thereby to secure the one ends of the leg members at an infinite numbers of selected points along the slots.

8 Claims, 5 Drawing Figures

ADJUSTABLE-HEIGHT ARTICLE OF FURNITURE

BACKGROUND OF THE INVENTION

1. Field of the Invention

This invention relates generally to adjustable-height articles of furniture, such as tables, chairs and the like.

2. Description of the Prior Art

Folding furniture, such as tables and chairs, are in common use. In the past, it has been known to provide for adjustment of the height of such articles of furniture by providing a pair of transversely spaced, longitudinally elongated members on the top member of the article, those elongated members having spaced notches therein which selectively receive pins on the ends of a pair of leg members thereby adjusting the angle of inclination of the leg members. In such prior articles of furniture, the height was adjustable only in discreet increments or steps and further, it was generally necessary to lift the table or chair in order to move the leg pins to another notch or, alternatively, to place the article of furniture on its side in order to affect the height adjustment.

It is therefore desirable to provide an adjustable-height article of furniture, such as a table or chair, in which the height can be adjusted in an infinite number of steps, i.e., in a continuous, stepless manner, without the necessity for lifting the table top or chair seat or placing the article of furniture on its side.

SUMMARY OF THE INVENTION

In accordance with the broader aspects of the invention, an adjustable-height article of furniture is provided having a generally horizontal top member with longitudinal and transverse dimensions. At least a pair of transversely spaced, elongated leg members is provided each having opposite ends. Means are provided on the top member having a pair of transversely spaced, longitudinally elongated slots formed therein, and one end of each leg member has a pin element secured thereto slidably received in a respective slot, the other end of each leg member being adapted to engage a supporting surface. A pair of transversely spaced, elongated support members is provided each having opposite ends, one end of each support member being pivotally connected to the top member at a point longitudinally spaced from the slots, and a point on each support member spaced from the one end thereof being pivotally connected to a respective leg member intermediate its ends. Elongated flexible elements are provided each having one end secured to a respective leg member adjacent its one end, and a pair of wedge means are provided on the top member respectively spaced longitudinally from the one ends of the leg members in the direction of the one ends of the support members for receiving and adjustably clamping the flexible elements thereby to secure the one ends of the leg members at an infinite number of selected points along the slots.

It is accordingly an object of the present invention to provide an improved adjustable-height article of furniture.

Another object of the invention is to provide an improved, adjustable-height article of furniture in which the height may be adjusted in an infinite number of steps without lifting the top of the article or turning the article on its side.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
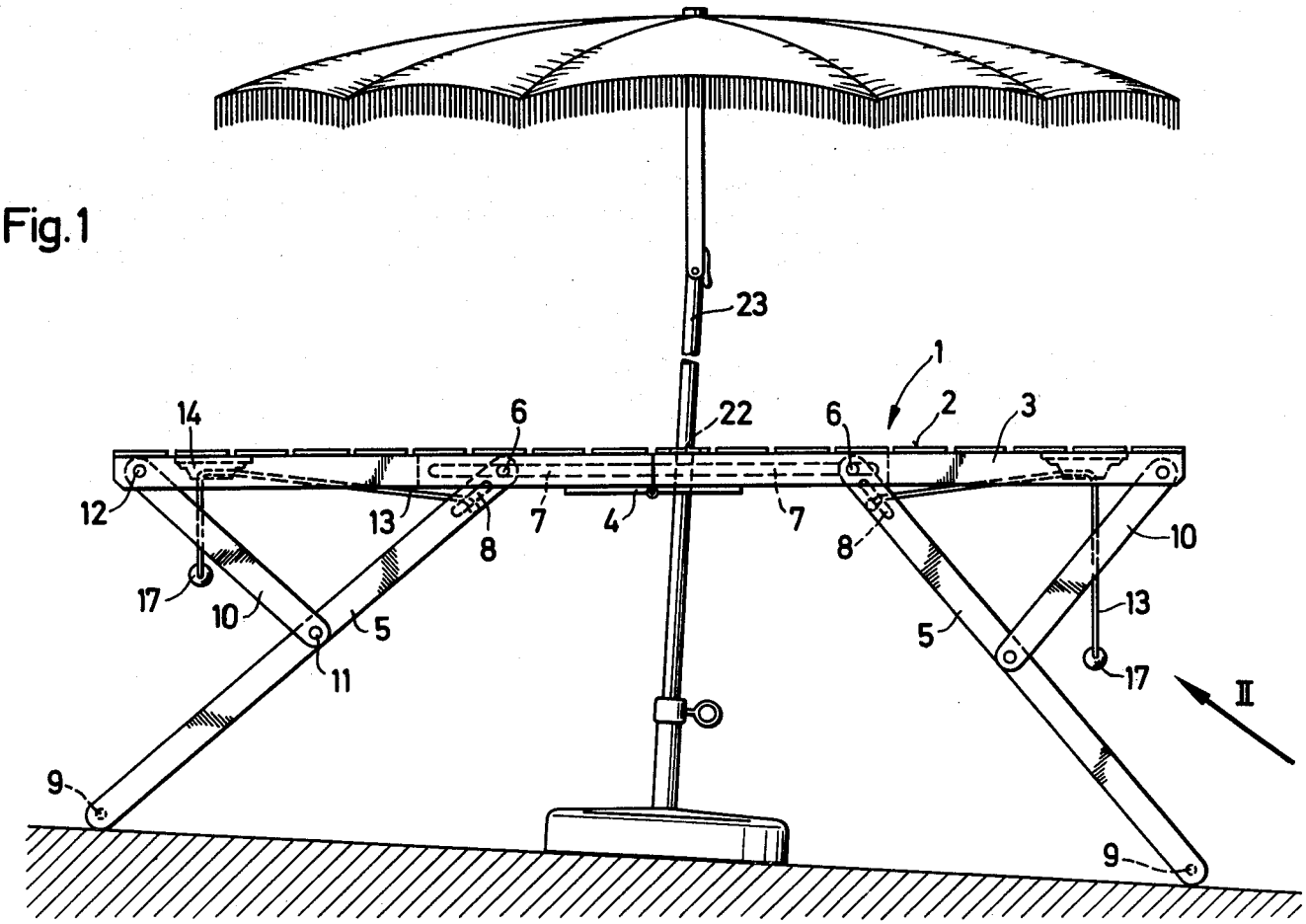
FIG. 1 is a side elevational view of a folding table incorporating the invention.
Figure 2:
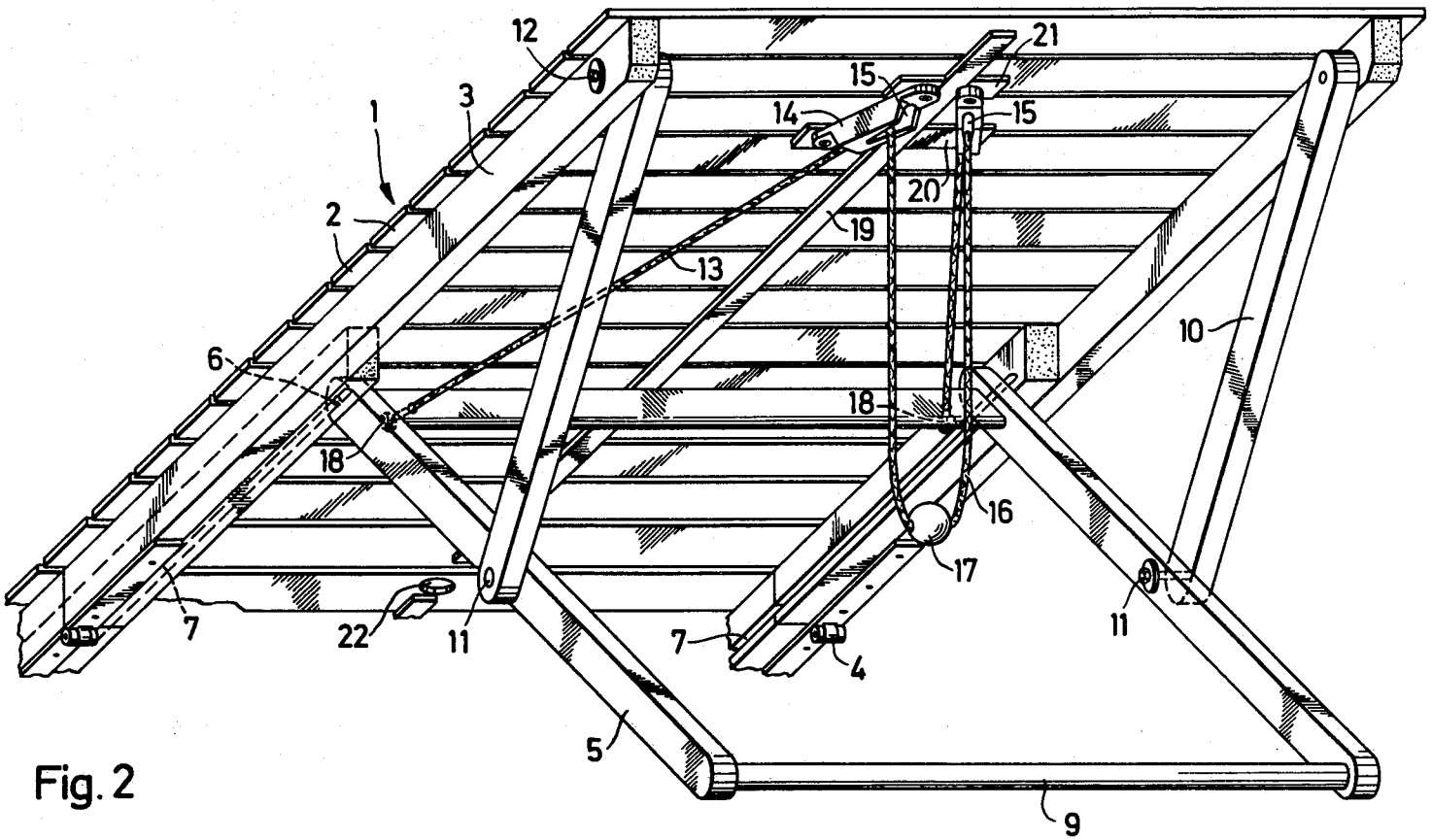
FIG. 2 is a fragmentary bottom perspective view of the folding table of FIG. 1.

Referring now to FIGS. 1 and 2, there is shown a folding table having a table top 1 formed of transversely extending slats 2 secured to transversely spaced, longitudinally extending supporting members 3. In order compactly to fold the table, supporting members 3 are divided into two sections connected by hinges 4.

Two pair of transversely spaced, elongated leg members 5 are provided, each pair of leg members 5 being joined adjacent their upper and lower ends by transverse members 8, 9. Each leg member 5 has pin 6 secured to and extending from its upper end and slidably received in longitudinally extending slot 7 in a respective table top support member 3. The lower ends of legs 5 adjacent transverse members 9 are adapted to engage a supporting surface thereby to support the table.

A pair of support members 10 cooperates with each pair of leg members 5 has one end pivotally connected, as at 11, to a respective leg member 5 intermediate its ends, and its other end pivotally connected to a respective table top support member 3, as at 12, at a point longitudinally spaced from the respective slot 7, as shown.

An elongated flexible element 13, such as a length of rope, is provided for each pair of leg members 5, flexible element 13 having its ends secured to the opposite ends of transverse member 8, as at 18 (FIG. 2). A pair of wedge members 14 is provided for each pair of leg members 5, wedge members 14 being secured to members 19, 20, 21 which, in turn, are secured to table top 1 adjacent its end remote from slots 7. Each wedge member 14 has a portion having a bore therethrough and another portion having a V or wedge-shaped opening 15 formed therein having its narrow end communicating with the bore and its wider end facing away from slots 7 and legs 5. Flexible element 13 extends through the bores of wedge members 14 thus defining loop section 16. Weight 17 is attached to loop section 16.

It will now be seen that in order to raise table top 1, loop section 16 of flexible element 13 is raised upwardly, as by means of weight 17, so as to disengage flexible element 13 from the wedge-shaped openings 15 of wedge members 14, and then loop 16 is pulled longitudinally outwardly in a direction away from legs 5 thereby pulling the upper ends of legs 5 away from hinges 4 to increase the angle of inclination of legs 5. When the desired height is obtained, loop section 16 is merely allowed to fall under the influence of weight 17 thereby clamping flexible element 13 in the wedge-shaped openings 15 of wedge members 14. Conversely, in order to lower table top 1, loop section 16 of flexible element 13 is again raised but without tension being maintained on weight 17 thereby releasing flexible element from wedge members 14, thus permitting the upper ends of legs 5 to move toward hinges 4 to decrease the angle of inclination of legs 5. It will thus be seen that with this arrangement, the height of table top 1 can be adjusted in an infinite number of steps, i.e., continuously in a stepless manner without the necessity for raising table top 1 or turning the table on its side.

In the embodiment illustrated in FIGS. 1 and 2, an umbrella is provided having supporting pole 23 extending through opening 22 in table top 1.

Figure 3:
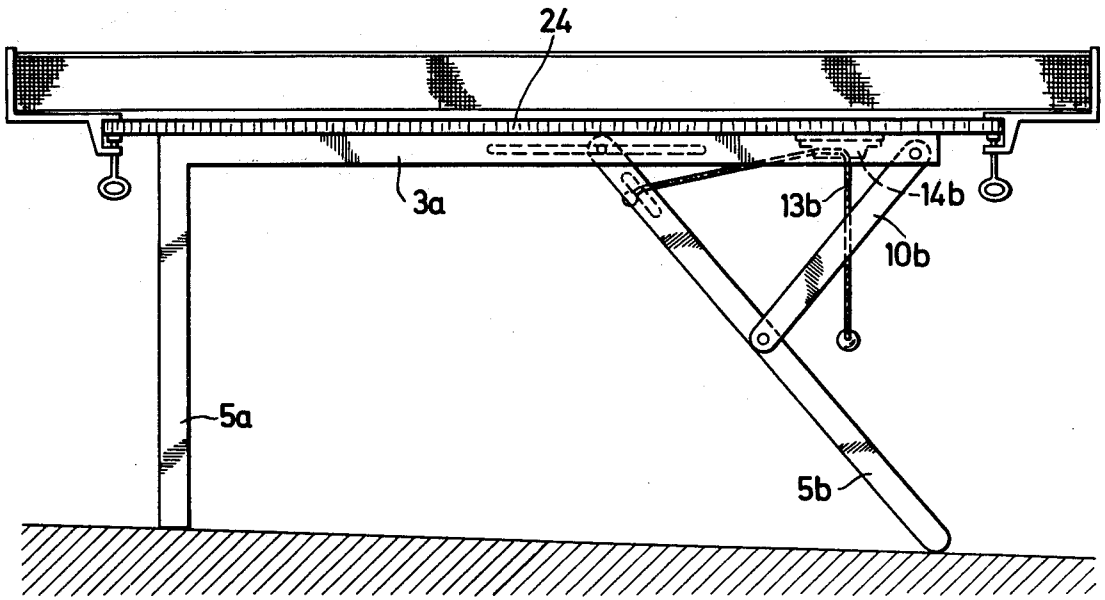
FIG. 3 is a side elevational view showing application of the invention to another type of table, such as a ping-pong table.

Referring now to FIG. 3 in which like elements are indicated by like reference numerals, a table is shown incorporating a pair of fixed-length leg members 5*a* and only one pair of adjustable leg members 5*b*, such arrangement being suitable for leveling the top 24 of a table such as a ping-pong table. Here, table top 24 is supported by transversely spaced support members 3*a*, support member 10*b* and wedge members 14*b* corresponding to support members 10 and wedge members 14 of FIGS. 1 and 2, and flexible element 13*b* likewise corresponding to flexible element 13 of FIGS. 1 and 2.

Figure 4:
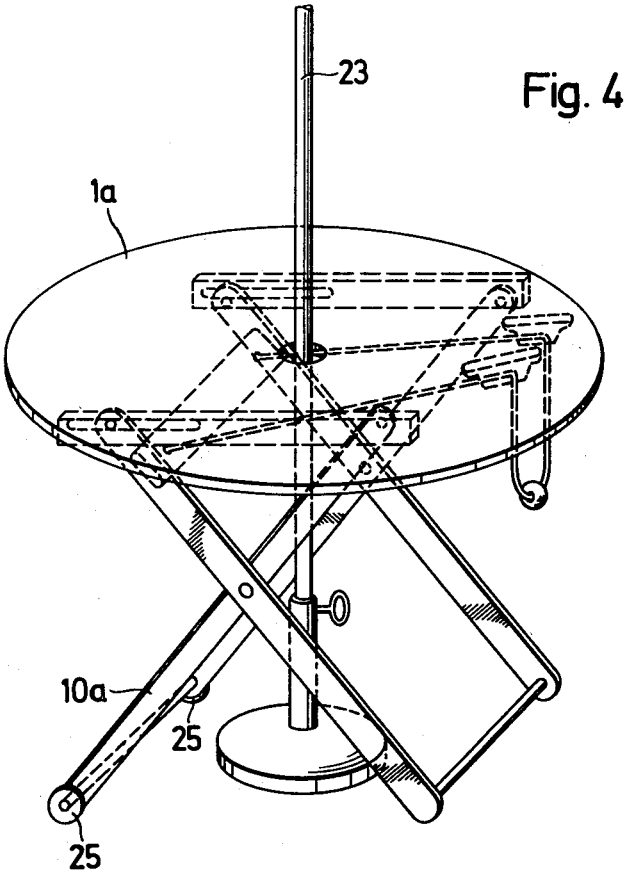
FIG. 4 is a view in perspective showing a table incorporating a modified form of the invention.

Referring now to FIG. 4 in which like elements are again indicated by like reference numerals, round table top 1*a* is supported by two pairs of leg members, leg members 10*a* being extensions of support members 10 of the embodiment of FIGS. 1 and 2. Rollers or wheels 25 may be provided at the lower ends of leg members 10*a* in order to enhance portability of the table. While the embodiment of FIG. 4 has been described in connection with a circular table top 1*a* again having umbrella pole 23 associated therewith, it will be readily understood that the same arrangement may be employed in connection with a folding chair.

Figure 5:
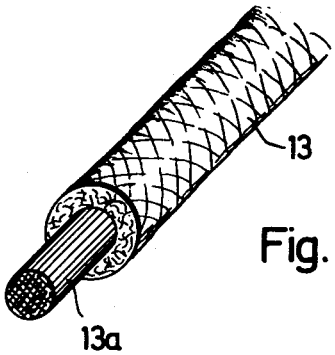
FIG. 5 is a fragmentary view in perspective showing the perferred form of rope employed in the invention.

Referring briefly to FIG. 5, flexible element 13 preferably comprises an outer braided or twisted section and an inner elastically compressable core 13*a*.

While there have been described above the principles of this invention in connection with specific apparatus, it is to be clearly understood that this description is made only by way of example and not as a limitation to the scope of the invention.

What is claimed is:

1. In an adjustable-height article of furniture comprising a generally horizontal top member having longitudinal and transverse dimensions, at least a pair of transversely spaced, elongated leg members each having opposite ends, means for pivotally securing one end of each leg member to said top member at selected longitudinal points thereon, the other end of each leg member being adapted to engage a supporting surface, and a pair of transversely spaced, elongated support members each having opposite ends, one end of each support member being pivotally connected to said top member at a point longitudinally spaced from said selected points, a point on each support member spaced from said one end thereof being pivotally connected to a respective leg member intermediate its ends; the improvement wherein said pivotal securing means comprises means on said top member having a pair of transversely spaced, longitudinally elongated slots formed therein, and a pin element secured to said one end of each leg member and slidably received in a respective slot, and further comprising a pair of elongated flexible elements, each having an end secured to a respective leg member adjacent said one end thereof, and a pair of wedge means on said top member respectively spaced longitudinally from said one ends of said leg members in the direction of said one ends of said support members for receiving and adjustably clamping said flexible elements thereby to secure said one ends of said leg members at an infinite number of selected points along said slots.

2. The article of claim 1 wherein said flexible elements are joined remote from said one ends thereof to form a loop section on the side of said wedge means remote from said leg members.

3. The article of claim 2 further comprising a weight member secured to said loop section thereby normally to retain said flexible elements clamped in said wedge means.

4. The article of claim 1 wherein said flexible elements are elastically compressible.

5. The article of claim 1 wherein each of said wedge means comprises a member having a portion with a bore therethrough for receiving the respective flexible element, and another portion having a wedge-shaped opening formed therein, said wedge-shaped opening having a narrow end communicating with said bore and a wider open end facing away from said leg members.

6. The article of claim 5 wherein said flexible elements are joined remote from said one ends thereof to form a loop section on the side of said wedge members remote from said leg members, and further comprising a weight member secured to said loop section thereby normally to retain said flexible elements clamped in said wedge members.

7. The article of claim 1 wherein the other end of each support member is spaced from said point thereon and adapted to engage said supporting surface.

8. The article of claim 1 or claim 6 wherein said top member comprises two sections hingedly connected for folding about a transverse line, said securing means pivotally securing one end of each leg member of said pair to one of said top member sections, said one end of each support member of said pair being pivotally connected to said one section, said pair of wedge means being on said one top member section, and further comprising a second pair of said leg members, second means for pivotally securing one end of each leg member of said second pair to the other of said top member sections at selected longitudinal points thereon, a second pair of said support members with one end of each pivotally connected to said other top member section at a point longitudinally spaced from said selected points thereon and a point on each spaced from the one end thereof being pivotally connected to a respective leg member of said second pair, a second pair of said elongated flexible elements each having an end secured to a respective leg member of said second pair adjacent said one end thereof, and a second pair of said wedge means on said other of said top member sections for receiving and adjustably clamping said second pair of flexible elements.

* * * * *